US006339983B1

(12) United States Patent
Mannhart

(10) Patent No.: US 6,339,983 B1
(45) Date of Patent: Jan. 22, 2002

(54) AMMUNITION-FEEDING DEVICE FOR A CANNON

(75) Inventor: Peter Mannhart, Eschenbach (CH)

(73) Assignee: Oerlikon Contraves AG, Zurich (CH)

( * ) Notice: Subject to any disclaimer, the term of this patent is extended or adjusted under 35 U.S.C. 154(b) by 0 days.

(21) Appl. No.: 09/453,167

(22) Filed: Dec. 2, 1999

(30) Foreign Application Priority Data

Dec. 4, 1998 (CH) ..... 2411/98

(51) Int. Cl.[7] ..... F41A 9/29

(52) U.S. Cl. ..... 89/33.16; 89/33.1; 89/33.14; 89/33.01

(58) Field of Search ..... 89/33.16, 33.25, 89/33.17, 33.4, 33.14, 33.12

(56) References Cited

U.S. PATENT DOCUMENTS

| | | | |
|---|---|---|---|
| B 439,669 | | 1/1975 | Ginsky |
| 3,921,499 A | * | 11/1975 | Ginsky |
| 4,066,000 A | * | 1/1978 | Rostocil |
| 4,093,055 A | * | 6/1978 | Blackburn et al. |
| 4,481,859 A | * | 11/1984 | Dix |
| 4,573,395 A | | 3/1986 | Stoner |
| 4,833,966 A | * | 5/1989 | Maher et al. |
| 4,876,940 A | * | 10/1989 | Aloi et al. |
| 4,882,972 A | * | 11/1989 | Raymond |
| 4,951,547 A | * | 8/1990 | Novet et al. |
| 5,107,750 A | * | 4/1992 | Buchstaller |
| 5,149,909 A | * | 9/1992 | Hagen et al. |
| 5,218,162 A | * | 6/1993 | Bender-Zanoni |
| 5,408,915 A | * | 4/1995 | Stoner |
| 5,535,661 A | * | 7/1996 | Lescure |

FOREIGN PATENT DOCUMENTS

| | | | |
|---|---|---|---|
| DE | 3219800 A1 | * | 1/1983 |
| EP | 152549 | * | 11/1984 |
| EP | 0272399 | | 4/1992 |
| EP | 0745826 | | 12/1996 |
| GB | 487371 | * | 6/1938 |

* cited by examiner

*Primary Examiner*—Michael J. Carone
*Assistant Examiner*—Troy Chambers
(74) *Attorney, Agent, or Firm*—Townsend and Townsend and Crew LLP; Guy W. Chambers

(57) ABSTRACT

In connection with this ammunition-feeding device, an axial transport device (19) with a conveyor chain (34) is provided between a conveyor (6) and a transfer station (20) for transferring cartridges (2) to a revolver drum (25) of a revolver cannon, by means of which the cartridges (2) are displaced in their longitudinal direction during transport vertically in respect to the movement direction of the conveyor chain (34). A buffer shaft (35) is provided for driving the conveyor chain (34), wherein the drive by means of the buffer shaft (35) takes place in such a way that, prior to being transferred to the transfer station (20), the cartridges (2) are brought into a buffer position.

11 Claims, 5 Drawing Sheets

AMMUNITION-FEEDING DEVICE FOR A CANNON

FIELD OF THE INVENTION

The invention relates to an ammunition-feeding device for a cannon, wherein the ammunition-feeding device has mechanisms for the conveyance and transfer of cartridges to the cannon.

BACKGROUND OF THE INVENTION

An ammunition-feeding device has become known from Swiss Pat. Application 01 587/95-6, which has a conveyor chain rotating in a housing of a magazine. Cups are provided on the conveyor chain, in which cartridges are held during the transport to a drum of a revolver cannon. Star-shaped reversing wheels and star-shaped transfer wheels, which are seated on a common rotatable shaft, are located at a reversing position of the conveyor chain facing the drum, wherein the reversing wheels are in engagement with the conveyor chain. A first conveyor link provided in the area of the reversing wheels takes over cartridges from the conveyor chain, or respectively the transfer wheels, wherein the cartridges are transported along a guide surface in the shape of an arc of a circle away from the transfer wheels to a second conveying link. The first conveying link consists of two trifurcate stars arranged on a common rotatable shaft, whose gaps are matched to the cross-sectional shape of the cartridges. The second conveyor link is also arranged to be rotatable and has a guide surface for guiding respectively one cartridge. A loading star is fastened on the drum and extends coaxially with it, to which the second conveying link transfers the cartridges. A scanning device arranged above a cartridge on the second conveying link, for example in the form of a photoelectric barrier, checks the position of the first cartridge. If a cartridge is present, a loading device is activated and the cartridges are pushed into the drum.

It is not possible to achieve faster rates of fire by means of the above described ammunition-feeding device. Moreover, the energy expenditure for conveying the cartridges is relatively great.

OBJECT AND SUMMARY OF THE INVENTION

It is the object of the invention to propose an ammunition-feeding device of the type mentioned at the outset, which does not have the above mentioned disadvantages.

This object is attained by means of an axial transport device with a conveyor chain, by means of which the cartridges are displaced during the transport in their longitudinal direction vertically in respect to the movement direction of the conveyor chain. A buffer shaft is provided for driving the conveyor chain, wherein the drive of the conveyor chain by means of the buffer shaft is performed in such a way that the cartridges are placed into a buffer position prior to being transferred to the cannon.

The advantages obtained by means of the invention are seen to be in particular in the buffering capability of the axial transport device, by means of which a more rapid rate of fire is made possible, and driving energy can be saved. Above all, the proposed axial transport device allows the seating of the cannon in the center of gravity, by means of which the dynamic behavior and the energy requirements of the elevation movement of the cannon are improved. Further advantages are to be seen in the modular construction of the ammunition-feeding device in accordance with the invention, so that production and maintenance costs can be lowered.

The invention will be explained in greater detail in what follows by means of several exemplary embodiments, making reference to the drawings.

DETAILED DESCRIPTION OF THE PREFERRED EMBODIMENTS

Figure 1:
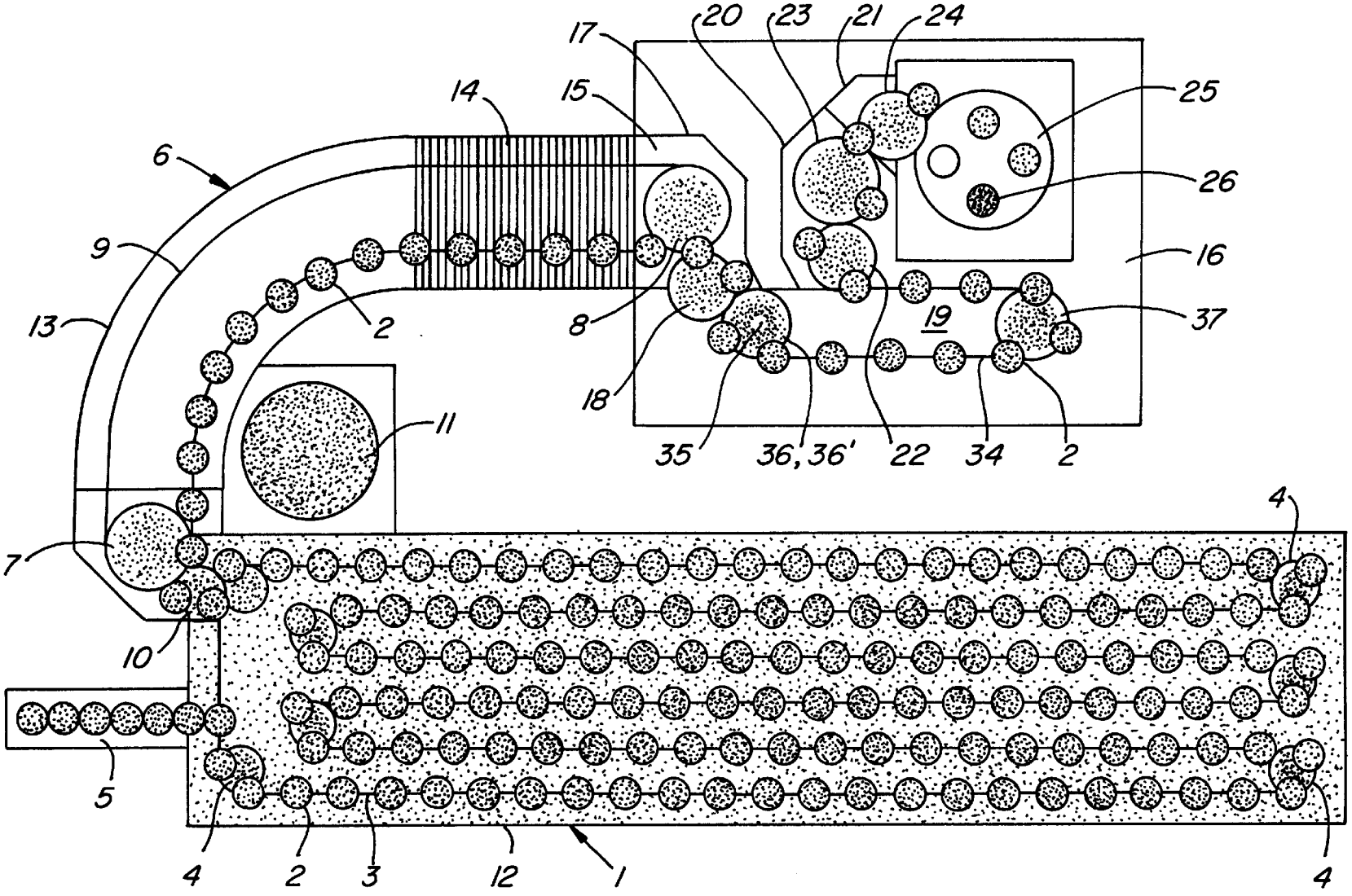
FIG. 1 is a schematic representation of the ammunition-feeding device in accordance with the invention.

In FIG. 1, a magazine is identified by 1, which has a conveyor chain 3, formed of cup-like holding links for cartridges 2, which is guided over chain reversing wheels 4 and which can be supplied with cartridges 2 via a loading opening 5. The magazine 1 is in connection with a conveyor 6, which also has a conveyor chain 9 formed of cup-like holding links for the cartridges 2 and is guided over chain reversing wheels 7, 8. By means of play between the holding links, the conveying chain 9 is able to store a few cartridges, so that it is possible to compensate special operating conditions or malfunctions. The cartridges 2 are transferred by means of a transfer wheel 10 from the magazine 1 to the conveyor 6, wherein the conveyor chains 3 and 9 of the magazine 1, or respectively of the conveyor 6, are driven by a motor 11. The conveyor chains 3 and 9 are guided in guide grooves, not represented, of housings 12 and 13 of the magazine 1, or of the conveyor 6. The conveyor 6 is connected with the cradle 16 of a revolver cannon via a flexible zone 14 for elevation compensation and via a conveyor reversing station 15.

Figure 2:
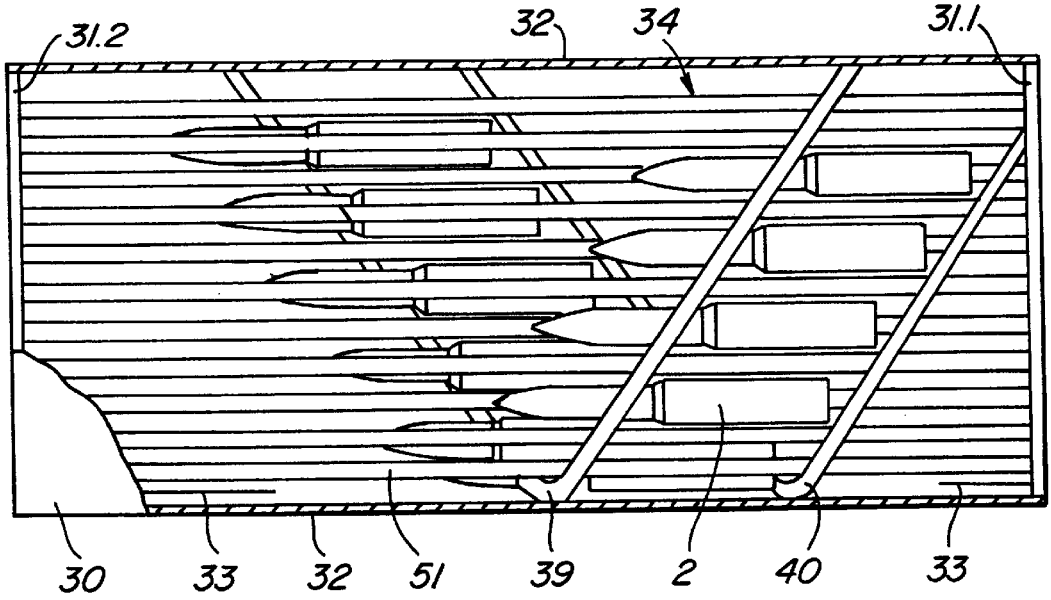
FIG. 2 is a view from above on the axial transport device of the ammunition-feeding device of FIG. 1 in a simplified representation.

The conveyor reversing station 15 consists of a housing 17 with a front transfer wheel 18, the chain reversing wheel 8 and a cup guidance and cartridge guidance, not represented. The cartridges 2 are transferred to the front transfer wheel 18 in the conveyor reversing station 15, and the empty conveyor chain 9 is reversed and guided back to the magazine 1. The front transfer wheel 18 transfers the cartridges 2 to an axial transport device 19, which will be described in greater detail later by means of FIG. 2. The conveyor reversing station 15 is connected via a gear with the axial transport device 19, wherein the gear is constituted of gear wheels arranged on the shafts of the chain reversing wheel 8 and the transfer wheel 18, as well as of a buffer shaft 35 (FIGS. 6 to 8) of the axial transport device 19.

The axial transport device 19 is connected via a further gear with a transfer station 20, which consists of a housing 21, a rear transfer wheel 22, a reversing wheel 23, a further transfer wheel 24, a compensating guide for the weapon recoil and a cartridge guide. The further gear is formed by gear wheels arranged on the shafts of the transfer wheels 22, 24 and the reversing wheel 23, as well as on the buffer shaft 35 of the axial transport device 19. The transfer station 20 takes over the cartridges 2 from the axial transport device 19 by means of the rear transfer wheel 22 and delivers them via the reversing wheel 23 and the further transfer wheel 24 to a revolver drum 25 of the revolver cannon. The revolver drum 25 has four cartridge layers, for example, the lowest of which is respectively located in the firing axis 26. The compensating guide compensates the recoil of the weapon in a manner not further represented and guides the cartridges 2 into the cartridge guide. The upper end of the compensating guide is rotatably seated on the housing 21, which also follows the recoil of the weapon, while the lower end of the compensating guide is fastened on the axial transport device 19.

Figure 3:
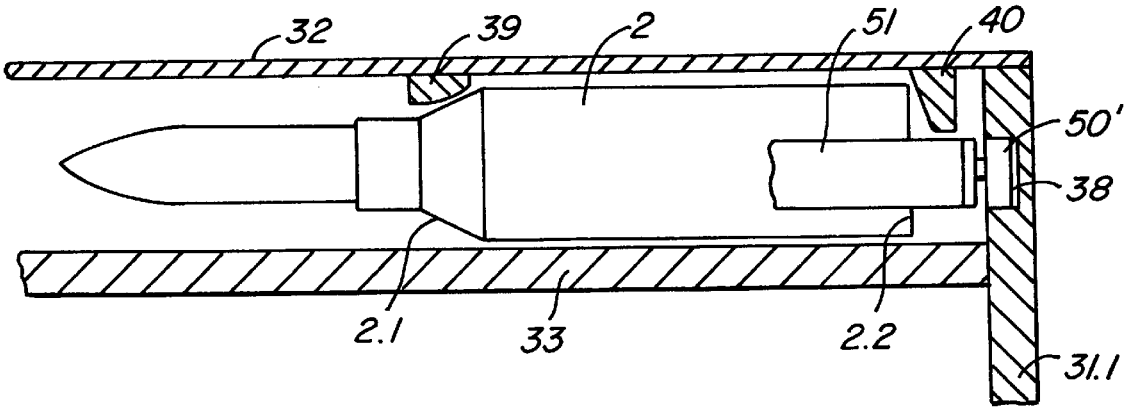
FIG. 3 shows axial guidance devices for the axial transport device in an enlarged scale.
Figure 5:
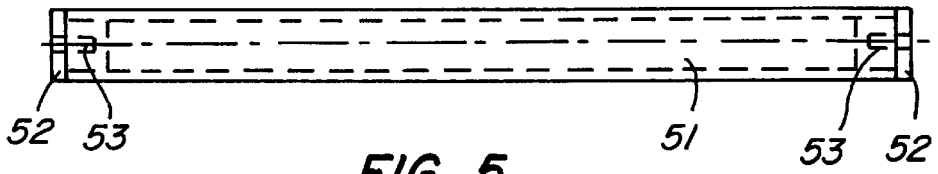
FIG. 5 shows a carrier tube of the conveyor chain in FIG. 4.
Figure 4:
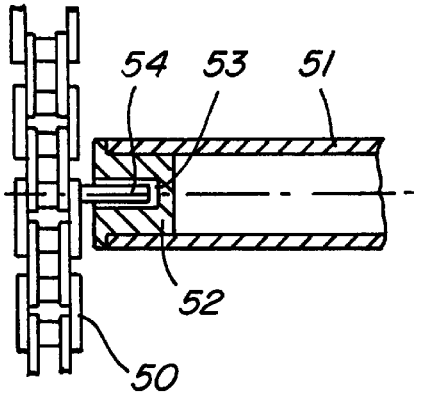
FIG. 4 shows a portion of a conveyor chain of the axial transport device.

In accordance with FIGS. 2 to 8, the axial transport device 19 consists of a housing 30, composed of two plates 31.1 and 31.2, a casing 32 and a guide plate 33, a conveyor chain 34, a buffer shaft 35, chain reversing wheels 36, 36' and two chain reversing wheels 37, wherein the chain reversing wheels 36, 36' are connected with each other by the buffer shaft 35, while the chain reversing wheels 37 are seated independently of each other at the plates 31.1, or respectively 31.2. Guide grooves 38 (FIG. 3) for the conveyor chain 34 are provided in the plates 31.1, 31.2. The casing 32 prevents cartridges 2 from falling out, and on the interior it has two axial guides 39, 40 (FIGS. 2, 3), which extend at a slant angle in relation to the conveyor chain 34 and by means of which the cartridges 2 are displaced in their longitudinal direction during transport vertically in respect to the movement direction of the conveyor chain 34. Starting at the entry of the cartridges 2 at the front transfer wheel 18 of the conveyor reversing station 15, the axial guides 39, 40 first cross the lower stringer and then the upper stringer of the conveyor chain 34 and end at the exit of the cartridges 2 at the rear transfer wheel 22 of the transfer station 20. During movement of the conveyor chain 34 in the direction toward the revolver drum 25, the one axial guide 39 leads the cartridges 2 at the shell mouth 2.1, while the other axial guide 40 controls the position of the cartridges 2 and, in the course of the movement of the conveyor chain 34 in the direction toward the conveyor 6, leads them at the shell bottom 2.2 (FIG. 3). The guide plate 33 is fastened on the plates 31.1, 31.2. In this way it spaces the two plates 31.1, 31.2 apart and guides, or respectively separates, the cartridges 2 in the two stringers of the conveyor chain 34 from each other.

In accordance with FIGS. 4, 5, 9 and 10, the conveyor chain 34 consists of two roller chains 50, 50' between which carrier tubes 51 are arranged. End pieces 52, which have receiving bores 53, are provided at the ends of the carrier tubes 51. Carrier pins 54 of the roller chains 50, 50' engage the receiving bores 53 with play, wherein the play is of such a size that an inclined position of the carrier tubes 51 of +/−2 degrees is possible.

Figure 6:
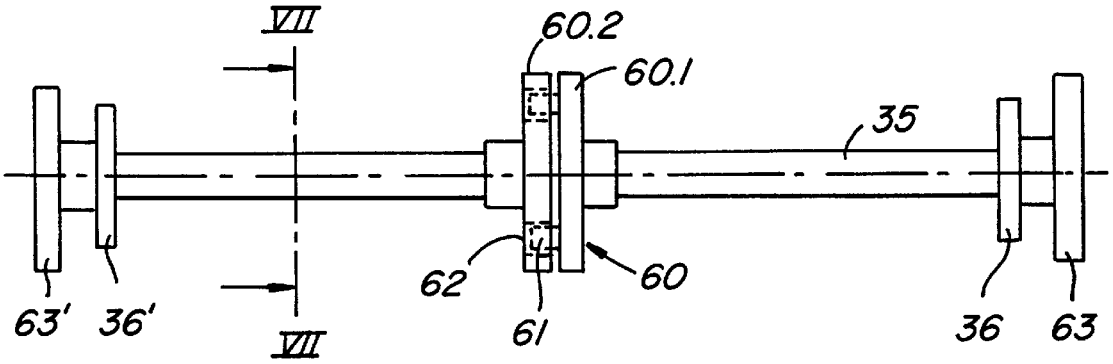
FIG. 6 shows a buffer shaft of the axial transport device.
Figure 7:
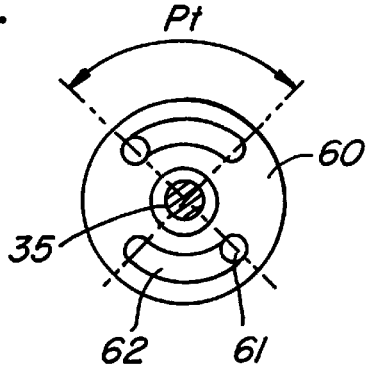
FIG. 7 represents a cross sectional view of the buffer shaft along the line VII—VII in FIG. 6.

In accordance with FIGS. 6 and 7, the buffer shaft 35 consists of two parts, which are connected with each other by means of a claw coupling 60. Bolts 61 are provided on the one coupling part 60.1, which engage slits 62 in the shape of an arc of a circle in the other coupling part 60.2. The arc length of the slits is of such a size that the coupling parts 60.1, 60.2 can be turned in respect to each other by a cartridge spacing Pt, or respectively the distance of the carrier tubes 51 of the conveyor chain 34 from each other. Gear wheels 63, 63' and the chain reversing wheels 36, 36' are fastened on the ends of the buffer shaft 35.

It is also possible to design the claw coupling with resilient detents instead of the fixed detents provided by the slits 62, as in FIGS. 6 and 7.

It is furthermore possible to design the buffer shaft 35 as a torsion shaft, wherein the turning up to a maximum torque corresponds to +/− one-half cartridge spacing P/t 2.

Figure 8:
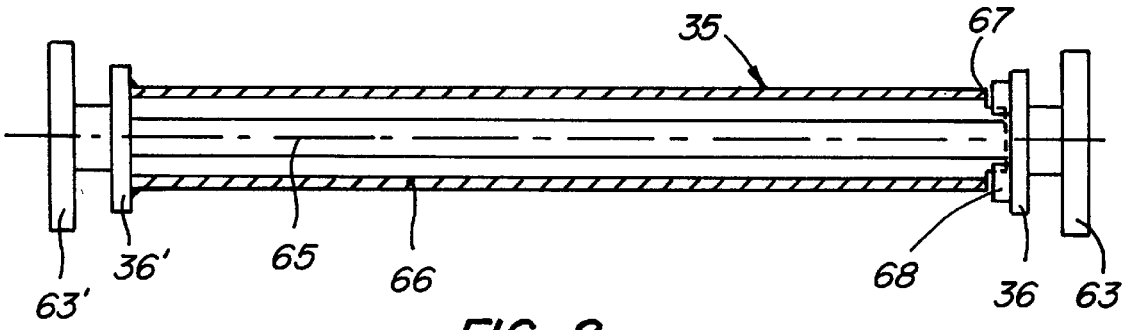
FIG. 8 is a longitudinal section of the buffer shaft in a second embodiment.

The buffer shaft 35 in accordance with FIG. 8 has a torsion shaft 65 and a detent tube 66 extending coaxially to it. The gear wheels 63, 63' and the chain reversing wheel 36, 36' are fastened at the ends of the torsion shaft 65. On its end, the detent tube 66 has two cutouts 67, which are engaged by detents 68 fastened on the one chain reversing wheel 36. The other end of the detent tube 66 is firmly connected with the other chain reversing wheel 36'. The arc length of the cutouts 67 is of such a size, that the torsion shaft 65 can be turned by one cartridge spacing Pt, or respectively by the distance between the carrier tubes 51 of the conveyor chain 34 from each other.

Figure 11:
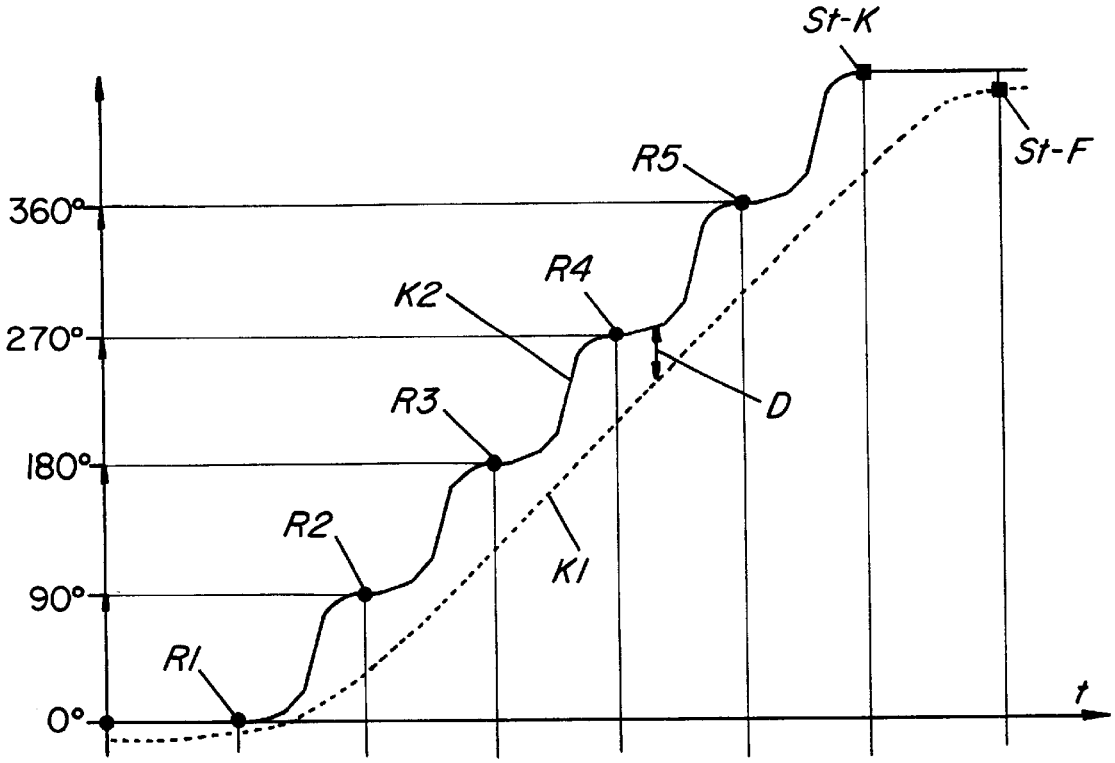
FIG. 11 is a distance/time diagram of the conveyor chain of the axial transport device.

Time is associated with the abscissa and the angle of rotation W of the revolver drum 25 with the ordinate in FIG. 11. A distance/time characteristic curve of the one roller chain 50 is identified by K1, and a distance/time characteristic curve of the other roller chain 50' is identified by K2. The coordinates R1 to R5 identify the instants of shots which are fired during a defined length of time during one rotation of the revolver drum 25. An occurring distance difference D between the two roller chains 50, 50' is compensated by means of the buffer effect of the axial transport device 19 achieved by the buffer shaft 35 and, if required, by the play in the conveyor chain 9 of the conveyor 6. Stops of the conveyor 6 and of the revolver cannon are identified by St-F and St-K.

Figure 9:
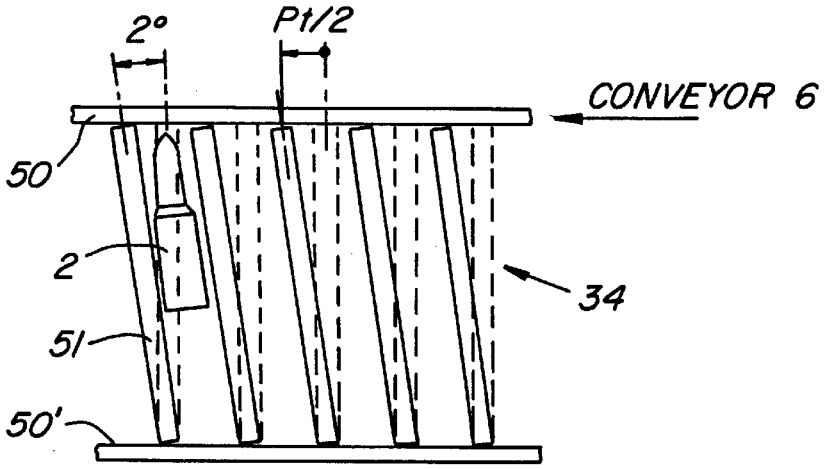
FIG. 9 is a first schematic representation of the functioning of the buffer shaft in FIGS. 6 and 8.

The above described axial transport device 19 operates as follows:

Prior to firing, the one roller chain 50 of the axial transport device 19 is driven by the drive of the conveyor reversing station 15 via the gear wheel connected with the front reversing wheel 18 and the gear wheel 63 of the buffer shaft 35, as well as via the chain reversing wheel 36, wherein the one part of the buffer shaft 35 is turned by half a cartridge length Pt/2 until it arrives at a detent (FIG. 9).

Figure 10:
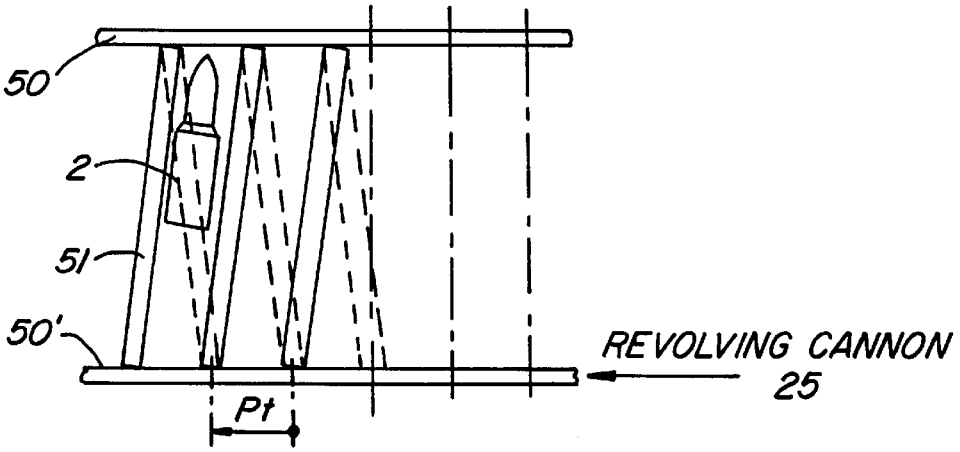
FIG. 10 is a second schematic representation of the functioning of the buffer shaft in FIGS. 6 and 8.

During this action, the gear of the transfer station 20 blocks the other roller chain 50' via the gear 63' and the other part of the buffer shaft 35 with the chain reversing wheel 36', so that the carrier tubes 51 of the conveyor chain 34 and the cartridges 2 are inclined by an angle of approximately 2 degrees out of the center position and take up a buffer position (FIG. 9). During firing, the canon can pull out one cartridge 2 without the roller chain 50 needing to move. Because of the explosive pressure generated during firing, the revolver drum 25 turns, so that the other roller chain 50' is very rapidly driven by the transfer station 20 and the gear wheel 63' as well as the chain reversing wheel 36' and the carrier tubes 51, as well as the cartridges 2 are inclined by an angle of approximately 2 degrees in the other direction (FIG. 10).

During firing, the roller chains 50, 50' of the conveyor chain 34 move simultaneously in accordance with the distance/time characteristic lines K1, or respectively K2, in FIG. 11. The revolver drum 25 of the cannon drives the roller chain 50' in steps, which moves quickly in the process and is stopped again, namely twice per shot (R1 to T5, K2, FIG. 11). The other roller chain 50 driven by the conveyor reversing station 15 runs continuously and follows the middle cadence of the cannon (K1, FIG. 11). In the process, drive energy is saved by making use of the buffering ability of the axial transport device 19, provided by means of the buffer shaft 35, and possibly because of the play in the conveyor chain 9 of the conveyor 6.

If a torsion shaft is used as a buffer shaft, the torsion shaft is pre-stressed out of its center position by half a cartridge spacing Pt/2 by the conveyor 6 prior to firing. During firing, the cannon relieves this stress when pulling off a cartridge 2 and then pre-stresses the torsion shaft in the opposite direction.

What is claimed is:

1. An ammunition-feeding device for a cannon comprising:

at least one conveyor chain for transporting ammunition cartridges to said cannon, whereby the direction of conveyor chain transport is generally perpendicular to the longitudinal axis of said ammunition cartridges; and, a buffer shaft connected to one of said conveyor chains for both driving said conveyor chain and slanting the axial orientation of said ammunition cartridges within said connected conveyor chain.

2. An ammunition-feeding device in accordance with claim 1, wherein said buffer shaft is part of an axial transport device which is positioned between a magazine and said cannon.

3. An ammunition-feeding device in accordance with claim 1, wherein at least one of said conveyor chains has two roller chains for carrying the cartridges along, said roller chains being connected with each other via carrier tubes.

4. An ammunition-feeding device in accordance with claim 3, wherein the carrier tubes have end pieces into which receiving bores are formed, wherein said carrier tube end pieces are received with play by pins protruding from said roller chains.

5. An ammunition-feeding device in accordance with claim 4, wherein the roller chains are driven independently of each other by means of the buffer shaft and a transfer station, wherein the roller chains are displaced from each other by a defined amount and the carrier tubes with the cartridges are inclined through the cooperative actions of the buffer shaft and transfer station.

6. An ammunition-feeding device in accordance with claim 5, wherein the defined amount is the distance of half a cartridge spacing on the conveyor chain.

7. An ammunition-feeding device in accordance with claim 1, wherein said buffer shaft consists of two parts which are connected with each other by means of a claw coupling, wherein bolts are provided on said first claw coupling part which engage slits in the shape of an arc of a circle on a second claw coupling part, wherein the arc length of the slits is of such a size that the coupling parts can be turned with respect to each other by the distance of a cartridge spacing on the conveyor chain.

8. An ammunition-feeding device in accordance with claim 1, wherein said buffer shaft is designed as a torsion shaft, on whose ends gear wheels and chain reversing wheels are fastened, wherein the turning of the torsion shaft up to the maximum moment is the distance of about half a cartridge spacing on the conveyor chain.

9. An ammunition-feeding device in accordance with claim 2, wherein said axial transport device has a housing consisting of two flat plates, a casing and a guide plate to guide the cartridges, wherein guide grooves for the conveyor chain are provided on the flat plates, and axial guides for the cartridges are arranged on the inside of the casing.

10. An ammunition-feeding device in accordance with claim 9, wherein said axial guides extend at a slant angle in relation to the conveying direction of the conveyor chain and parallel with each other.

11. An ammunition-feeding device for a cannon comprising:

at least one conveyor chain for transporting ammunition cartridges to said cannon, whereby the direction of conveyor chain transport is generally perpendicular to the longitudinal axis of said ammunition cartridges; and, a buffer shaft connected to one of said conveyor chains for both driving said conveyor chain and slanting the axial orientation of said ammunition cartridges within said connected conveyor chain, wherein said buffer shaft has a torsion shaft and a detent tube extending coaxially therewith, two chain reversing wheels and gear wheels are fastened at the end of the torsion shaft, said detent tube has two cutouts at one end, which are engaged by detents attached to one chain reversing wheel, wherein the arc length of the cutouts is of such a size that the torsion shaft can be turned by the distance of one cartridge spacing on the conveyor chain, and the other end of the detent tube is firmly connected with the other chain reversing wheel.

* * * * *